US010471291B2

(12) United States Patent
Alves Mourao

(10) Patent No.: US 10,471,291 B2
(45) Date of Patent: Nov. 12, 2019

(54) FOLDABLE GYM MACHINE

(71) Applicant: Fernando Alves Mourao, Sao Paulo (BR)

(72) Inventor: Fernando Alves Mourao, Sao Paulo (BR)

( * ) Notice: Subject to any disclaimer, the term of this patent is extended or adjusted under 35 U.S.C. 154(b) by 0 days.

(21) Appl. No.: 15/566,925

(22) PCT Filed: May 4, 2016

(86) PCT No.: PCT/BR2016/000049
§ 371 (c)(1),
(2) Date: Oct. 16, 2017

(87) PCT Pub. No.: WO2016/176751
PCT Pub. Date: Nov. 10, 2016

(65) Prior Publication Data

US 2018/0133531 A1 May 17, 2018

(30) Foreign Application Priority Data

May 5, 2015 (BR) ..... 202015010152-5

(51) Int. Cl.
*A63B 17/04* (2006.01)
*A63B 23/00* (2006.01)

(52) U.S. Cl.
CPC ..... *A63B 17/04* (2013.01); *A63B 23/00* (2013.01)

(58) Field of Classification Search
None
See application file for complete search history.

(56) References Cited

U.S. PATENT DOCUMENTS 3,735,979 A * 5/1973 Levenberg ..... A63B 9/00 482/143
4,927,135 A * 5/1990 Nieppola ..... A63B 9/00 182/95

(Continued)

FOREIGN PATENT DOCUMENTS

CH 577327 7/1976
DE 2911876 A1 10/1980

(Continued)

*Primary Examiner* — Garrett K Atkinson

(57) ABSTRACT

Patent of utility model pertaining to the non-motorized equipment for the practice of gymnastics constituted with a base, wall support with a format predominantly rectangular provided with holes in the edges and tabs for the fixation of the superior bar of the superior part through fastening elements, as well as holes for fixation in the wall, having a protective cover keeping practically the disposition of the support base. The referred machine is composed at it frontal part of a structure formed by a curved bar provided of a plurality of steps, the top being composed by two opening limiting overhangs in the lateral parts, and the base has a height adjustment through rods composed by cylindrical tubes with pluggable supports, the height being regulated by pins, in a way that the first step is provided with a vertical rod to fix weights. The superior part is composed by a cylindrical curved bar provided of at least two opening limiting supports with a rectangular format, that are fixed in the surface of the same, the edges are closed with covers, the superior part is provided with fastening elements that work as an articulation of the stair.

1 Claim, 5 Drawing Sheets

(56) References Cited

U.S. PATENT DOCUMENTS

| | | | | |
|---|---|---|---|---|
| 5,031,605 | A | 7/1991 | Mills | |
| 7,037,244 | B2 * | 5/2006 | Svihra | A63B 23/12 482/135 |
| 7,481,741 | B1 * | 1/2009 | Sammann | A63B 9/00 482/35 |
| 7,699,756 | B2 * | 4/2010 | Piane, Jr. | A63B 1/00 482/38 |
| 8,834,332 | B2 * | 9/2014 | Campanaro | A63B 21/00072 482/142 |
| 2004/0248712 | A1 * | 12/2004 | Svihra | A63B 23/12 482/93 |
| 2007/0078014 | A1 * | 4/2007 | Nye | A63B 9/00 472/116 |
| 2008/0051257 | A1 * | 2/2008 | Hamblin | A63B 9/00 482/35 |
| 2009/0072111 | A1 * | 3/2009 | Piane, Jr. | A63B 1/00 248/309.1 |
| 2012/0053028 | A1 * | 3/2012 | Campanaro | A63B 21/00072 482/131 |

FOREIGN PATENT DOCUMENTS

| | | | |
|---|---|---|---|
| DE | 10361984 | A1 | 8/2014 |
| FR | 2315291 | A1 | 1/1977 |
| MU | 8302830-7 | | 7/2005 |
| MU | 9002036-7 | | 2/2013 |

* cited by examiner

FOLDABLE GYM MACHINE

BACKGROUND OF THE INVENTION

The present descriptive report of the patent of the utility model of a new constructive disposition applied in Gym Machines, notably a practice set aimed for exercise practices, innovative conception and containing important technological and functional improvements, in accordance with the most modern engineering concepts and in accordance with the standards and required specifications, filled with proper characteristics and equipped with fundamental requirements of innovation and inventive act, resulting in a series of real and extraordinary technical advantages, economic practices.

Actually there are many models of gym machines in the market. However, as it is known by the technicians in the subject, these devices are complex and expensive, both in the production and maintenance parts for the consumers.

In this sense, some inventors idealized the products object of the patent documents indicated below, but they did not attend the simplicity details.

SUMMARY OF THE INVENTION

The document of the patent MU 8302830-7 deposited on Nov. 10, 2003 entitled as constructive disposition introduced in a gym machine teaches a machine that comprehends a general structure, composed by a support column, where tapes are applied, a support bar, where two supports are fixed, a bar, having in its longitudinal extension, a plurality of holes and a recess, a supplementary support structure, having bases, a board, that has a bottom fixation part, a fastening part and a front fastening part, an instrument, having lateral fixation supports, a supplementary bar, mounting pins, central lever, an instrument, having a support part, a rod, curved posterior lever, horizontal beam, support pins, mounting pins, articulation lever, front lever, an instrument, having a support central base, lateral levers, mounting pins, fastening elements, locking structures and rubber elements.

The patent document MU 8102816-4 deposited on Nov. 21, 2001 entitled constructive dispositions introduced in a machine with tilted structure for gymnastics and weight training teaches a device composed by a structure of tilted elements that, when the device is not being used, occupies a reduced space, easing the transportation and handling. The innovation consists of a device constituted in an elongated rectangular platform formed by two boards 1 and 2, each one of them having two united stringers by a crossbar, the free extremes of the stringers receiving two hinges that connect the two boards, allowing the tipping, the posterior board having two opposed holes next to the crossbar, which receive pins that allow the rotation of a support, that can receive a cylindrical bar that passes through opposed holes existent in the its legs, while the previous board receives a second tilting support pivoted to pins disposed in holes placed in the stringers, next to the previous crossbar, the legs of this support being predisposed to receive a transversal bar fixed in two opposed holes in these legs, each one of them covering a pair of little rollers or pulleys that receive a steel cable disposed in the interior of the leg, having the extreme superior fixed to a little handle, while the other extremity is locked in a eyebolt existent in the base of the a Rectangular car formed by a flat plate eventually covered with a pad, for a better comfort of the user, being that both sides of this plate have two pairs of short vertical projections that sustain respective rolling bars supported and guided by the stringers, the crossbar having a central through hole that receives a metallic pin, that penetrates in one of the existent holes in the vertical rod of one tower which the foot is formed by an elongated crossbar.

The patent document MU 9002036-7 deposited on Oct. 4, 2010 entitled as portable device for gymnastics with a double function teaches a device to be fixed in door steps, so that the user can execute series of muscular strength and extension exercises in the correct and precise form, exercising, strengthening and modeling the muscles of the shoulders, arms, chest, legs and buttocks, adequate exercises for those that wish to improve the physical conditioning and muscular endurance, and for that, the mentioned device is easy to assemble and to store, it has an easy handling and present a low cost for its industrial feasibility.

Analyzing the documents mentioned before and known of the technique status, as it can be observed, none of them integrally presents the constructive characteristics of the gym machine object of this present patent.

In view of this, through the time some studies were made aiming to eliminate all these problems and inconveniences and, as a result, this device was developed, enabling the conception of a new concept of exercises practice, from which the possibility to practice exercises arises and after storing it without occupying a large space, obtaining an integrated product with real possibilities of an economic industrialization, minimizing costs, mounting time and labor expenses, in addition to a precise mounting effect, with better results and elevated safety standard.

Therefore, this patent of utility model has the objective to provide a compact gym machine, where it is possible to do multiple exercises in a reduced space.

1. It allows the execution of many exercises in one tiny space, so, it can be installed in a room, lounge or garage.
2. When collected, it does not occupy space.
3. Easy to handle, because it can be assembled in 5 seconds and is easily fitted in 5 seconds.
4. It substitutes the gym practice, since the athlete has experience.
5. Support for weights.
6. There are no similar machines in the market, if we see that, to do all the exercises proposed by it, it would need many machines, that can be composed in a room or lounge.
7. Comfort
8. Simplicity.
9. Weighting approximately 25 kg, it is extremely light for a machine with such multiple functions.
10. Unisex, able to be used by people of all ages and biotypes.

These and other objectives are reached with a disposition that comprehends a wall support base with a format that is predominantly rectangular provided with holes in the edges and Securing tabs in the superior bars of the superior part through fastening elements, as well as holes for fixation in the wall, having a protective cover maintaining practically the disposition of the support base.

The referred machine is composed at it frontal part of a structure formed by a curved bar provided of a plurality of steps, the top being composed by two opening limiting overhangs in the lateral parts, and the base has a height adjustment through rods composed by cylindrical tubes with pluggable supports, the height being regulated by pins, in a way that the first step is provided with a vertical rod to fix weights.

The superior part is composed by a cylindrical curved bar provided of at least two opening limiting supports with a rectangular format, that are fixed in the surface of the same, the edges are closed with covers, the superior part is provided with fastening elements that work as an articulation of the stair.

BRIEF DESCRIPTION OF THE DRAWINGS

To complement the present description, in a way to obtain a better comprehension of the characteristics of the present patent, and in accordance with a preferential practical realization of the same, a set of drawings appears in the annex, where the following are represented in a exemplified and non limitative way.

DETAILED DESCRIPTION OF THE INVENTION

Figure 1:
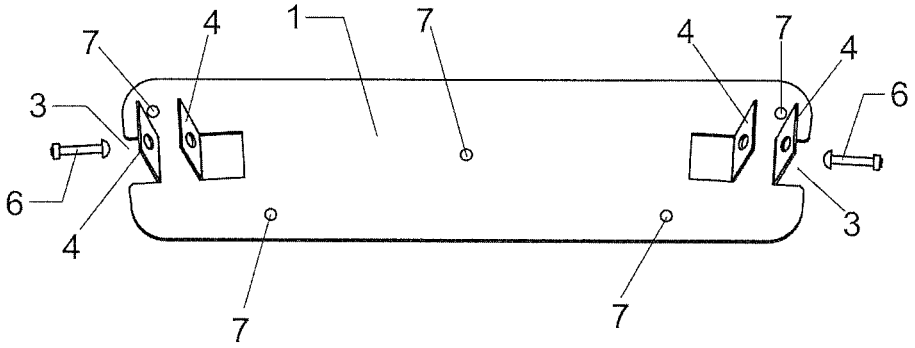
FIG. 1 represents the frontal view of the fixation base of the gym machine.
Figure 2:
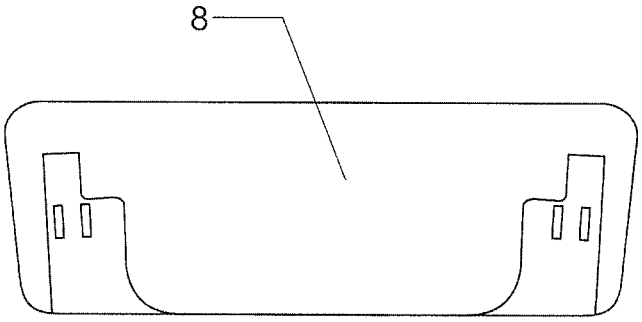
FIG. 2 represents the frontal view of the protective cover of the fixation base of the gym machine.
Figure 3:
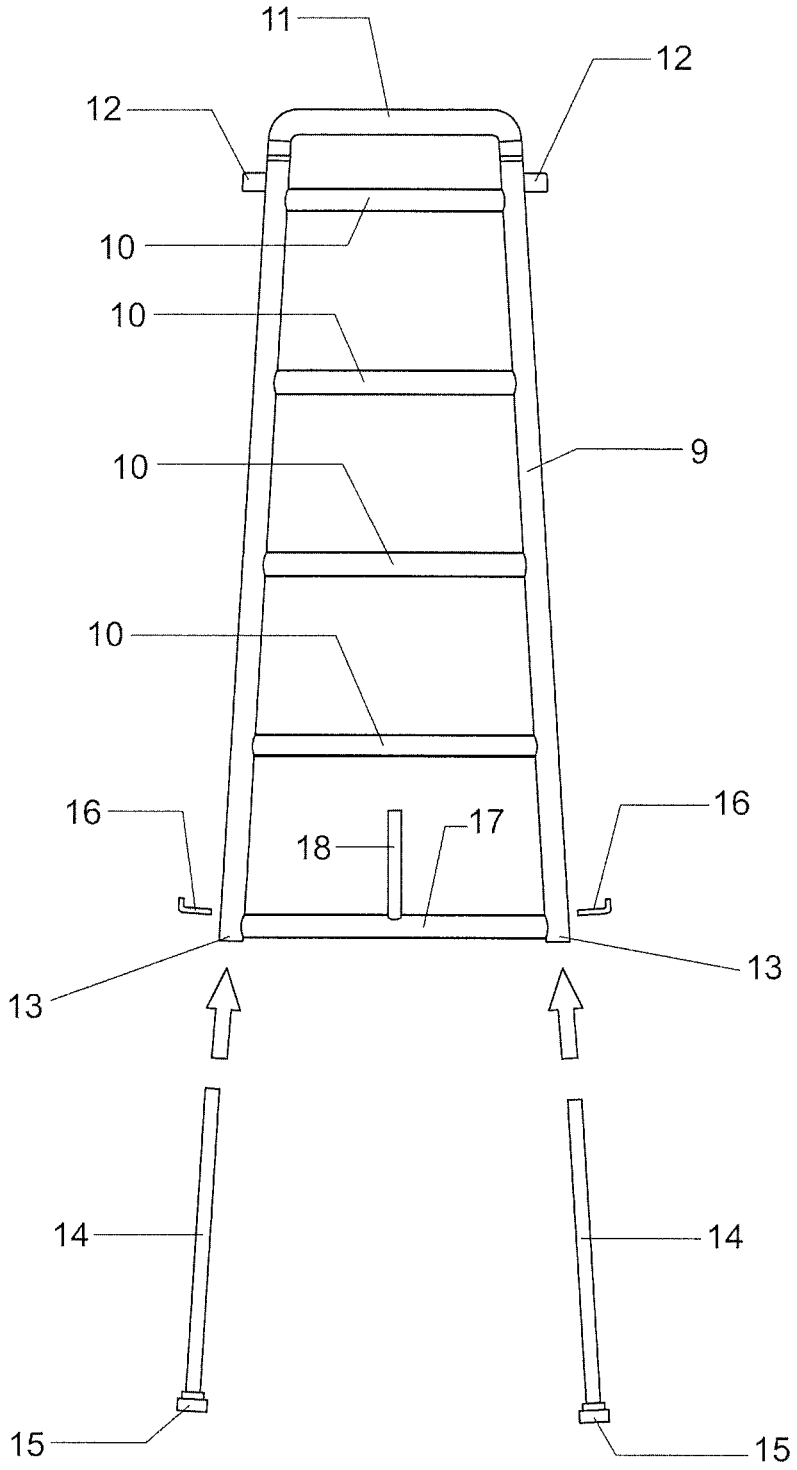
FIG. 3 represents an exploded view of the support structure.
Figure 4:
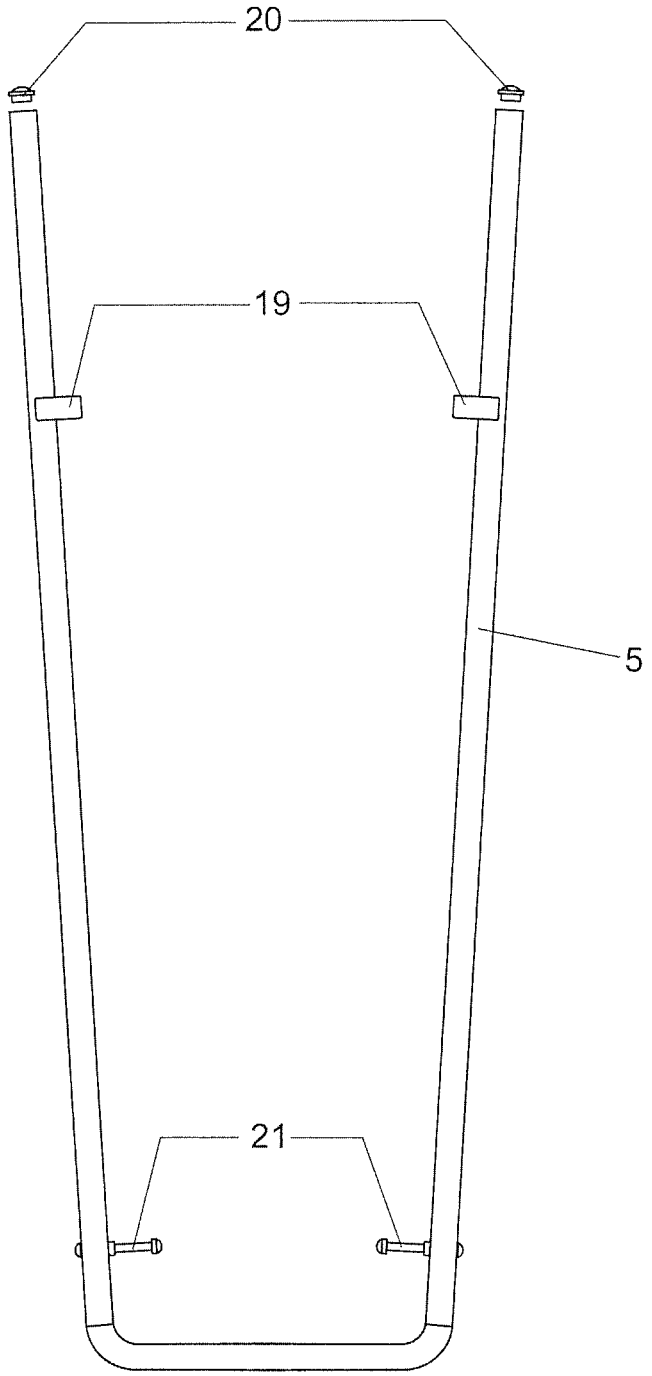
FIG. 4 represents a superior view of the superior structure of the machine.
Figure 5:
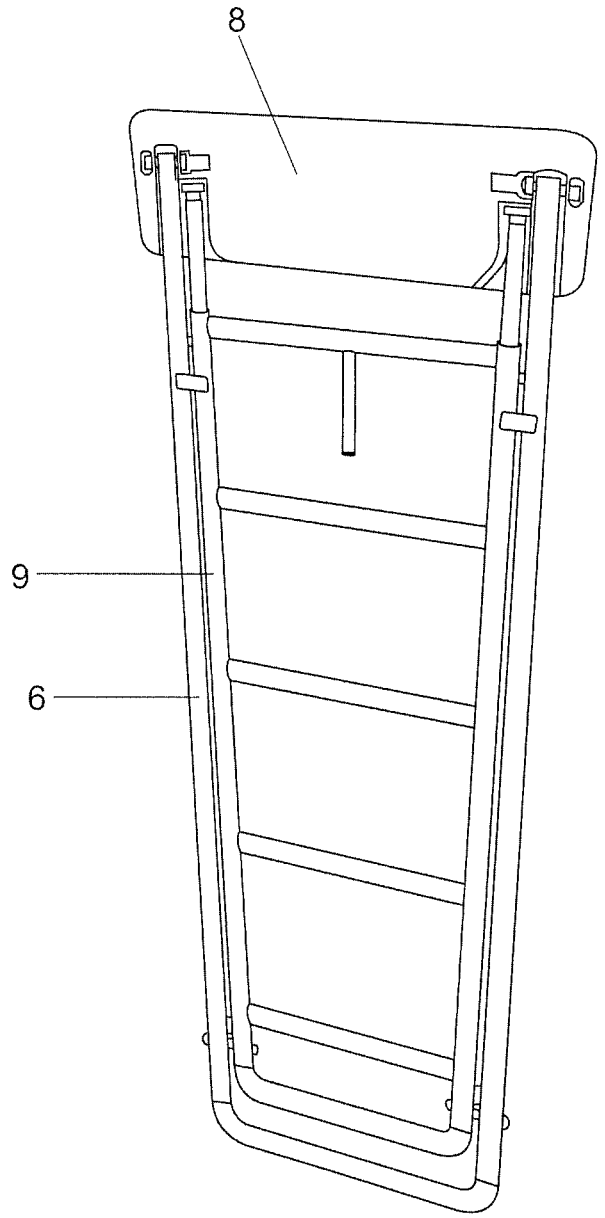
FIG. 5 represents the view of the gym machine object of this present patent, in its collected state.
Figure 6:
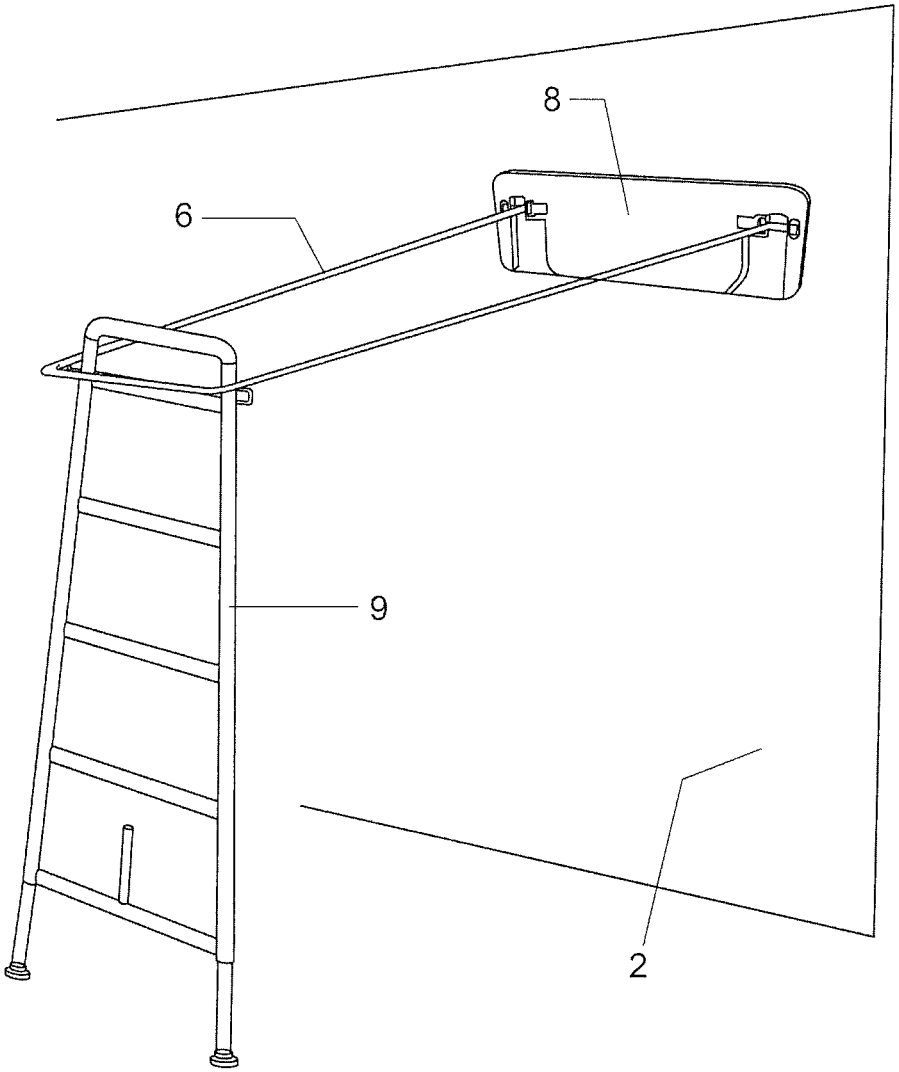
FIG. 6 represents the view of the gym machine object of this present patent, also mounted and ready to be used.

In accordance with the referred figures, and its particularities, the present patent is constituted with a base (1) wall support (2) with a format predominantly rectangular provided with holes (3) in the edges and tabs (4) for the fixation of the superior bar (5) of the superior part through fastening elements (6), as well as holes (7) for fixation in the wall (2), having a protective cover keeping practically the disposition of the support base (1).

The referred machine is composed at it frontal part of a structure formed by a curved bar (9) provided of a plurality of steps (10), the top (11) being composed by two opening limiting overhangs (12) in the lateral parts, and the base (13) has a height adjustment through rods (14) composed by cylindrical tubes with pluggable supports (15), the height being regulated by pins (16), in a way that the first step (17) is provided with a vertical rod to fix weights (18).

The superior part is composed by a cylindrical curved bar (5) provided with two opening limiting supports with a rectangular format, that are fixed in the surface of the same (19), the edges are closed with covers (20), the superior part is provided with fastening elements (21) that work as an articulation of the stair.

There are no machines like this in the market that jointly gathers, all the constructive and functional characteristics previously related, and that directly or indirectly is or was as effective as the device object of the present patent.

It is evident for the experts of the subject that while the preferred realization of the introduced constructive disposition of this object is described, any amendments and/or changes must be comprehended as inside the scope of the model patent of utility, being framed as in the scope of the utility model patent, being perfectly framed in the defined criteria, that is, the modification combination of elements already known in a new disposition form, involving the inventive act, resulting in a functional improvement in its use or manufacturing.

The invention claimed is:

1. A foldable gym device, comprising:

a base configured to be mounted on a wall, the base having mounting tabs and wall mounting holes;

protective cover fitting on the base, the protective cover having slits through which the mounting tabs of the base pass;

a superior part having a superior bar, the superior bar having first and second ends, the first end of the superior bar rotatably fastened to the mounting tabs of the base extending through the protective cover;

a composed device having a top, height-adjustable legs and a plurality of intervening bars, the top being rotatably fastened to the second end of the superior bar of the superior part, the top composed by two limiting overhangs in the lateral parts, a first end of the legs connected to the two limiting overhangs of the top and including rods composed by cylindrical tubes with pluggable supports, a height of the leg being regulated by pins inserted into the legs and the rods, the plurality of intervening bars each having ends connected respectively to the legs thereby forming a ladder-shape step, one of the plurality of intervening bars closest to a second end of the legs being provided of a vertical rod arranged to fix weights;

wherein the superior bar of the superior part includes a pair of abutting elements that abuts the legs of the composed device when folded on the wall, the first end of the superior part is closed with covers, the superior part is provided with fastening elements that work as an articulation of the superior bar, and wherein the top and legs of the composed device form a U shape, the superior bar of the superior part forms a U shape, the U shape of the composed device fits inside the U shape of the superior bar of the superior part when folded on the wall.

* * * * *